US005306005A

United States Patent [19]

Lacoste et al.

[11] Patent Number: 5,306,005

[45] Date of Patent: Apr. 26, 1994

[54] TENNIS RACKET

[75] Inventors: Rene Lacoste; Alain Gallais, both of Paris, France

[73] Assignee: La Chemise Lacoste (S.A.), Paris, France

[21] Appl. No.: 19,753

[22] Filed: Apr. 8, 1993

Related U.S. Application Data

[63] Continuation-in-part of Ser. No. 781,635, Oct. 18, 1991, abandoned, which is a continuation of Ser. No. 465,103, Dec. 26, 1989, abandoned.

[51] Int. Cl.[5] ..... A63B 49/02

[52] U.S. Cl. ..... 273/73 C

[58] Field of Search ..... 273/73 R, 73 C, 73 D, 273/73 F, 73 H, 73 K

[56] References Cited

U.S. PATENT DOCUMENTS 801,246 10/1905 Johnson ..... 273/73 D
1,694,360 12/1928 Larned ..... 273/73 D
2,626,804 1/1953 Robinson ..... 273/73 D X
3,664,668 5/1972 Held ..... 273/73 D X
4,834,383 5/1989 Woehrle et al. ..... 273/73 D X
5,137,273 8/1992 Jseng ..... 273/73 D

FOREIGN PATENT DOCUMENTS 3426798 1/1986 Fed. Rep. of Germany .... 273/73 C

*Primary Examiner*—William Stoll
*Attorney, Agent, or Firm*—Marshall, O'Toole, Gerstein, Murray & Borun

[57] ABSTRACT

A generally oval tennis racket characterized in that its strung surface comprises five zones: a central zone (A) including the geometric center (M) and the center of percussion (P) and having at least three cross strings; and on either side thereof two zones (B and C) each having at least three cross strings whose average length exceeds that of the cross string in the central zone (A). This construction increases the area (sweet spot) over which resilience is substantially uniform.

6 Claims, 7 Drawing Sheets

TENNIS RACKET

This application is a continuation-in-part of U.S. Ser. No. 07/781,635 filed Oct. 18, 1991 now abandoned, which is a continuation of application Ser. No. 07/465,103, filed Dec. 26, 1989, abandoned.

The present invention relates to a mid-size tennis racket having an enlarged zone ("sweet spot") in its strung surface wherein contact with the ball provides excellent energy restitution and playing accuracy. The racket includes a rigid frame delimiting a strung surface comprising strings generally called main strings running parallel to the axis of symmetry X of the frame and strings generally called cross strings running parallel to an axis Y perpendicular to the axis X and crossing the axis X substantially in the middle of a section $X_1$ of axis X of said frame between the yoke and the other end of the frame, generally called the tip.

BACKGROUND OF THE INVENTION

In 1965, the strung surface of most tennis rackets had remained unchanged for many years, and rarely exceeded 451 $cm^2$. However, since 1970, the use of metal and above all of plastic materials reinforced with glass fibers and sometimes with carbon, boron, or ceramic fibers, has made it possible to manufacture large-size frames with strung surfaces of as much as 680 $cm^2$, i.e., more than 50% greater than the usual conventional surface of 451 $cm^2$, and having a more or less oval shape with a long axis which is sometimes more than 34 cm long and with a short axis which may be more than 26 cm long. Such rackets are described in U.S. Pat. No. 3,999,756.

With such strung surfaces, the lengths of the main strings and of the cross strings are naturally increased. This gives rise to improved resilience of the stringing as a whole and an increase in the size of the zone in which said resilience gives rise to high energy restitution.

With a large-size racket weighing less than 340 grams, it is possible to impart nearly as much speed to a ball as when using a racket having a strung area of 451 $cm^2$ and a weight of 375 g.

Many beginners, older players, and players who play tennis only occasionally, greatly appreciate such rackets which require little force for obtaining a satisfactory result.

However, other players, in particular the best players, consider that the large size of the frame increases the aerodynamic drag of the racket and makes it more difficult to handle, in particular hindering the quick movement required for return of service.

Further, when the speed of play is due above all to the high resilience of the strings of large-size rackets, it is not possible to obtain adequate accuracy and control.

In any event, all players appreciate the advantages of rackets having an area of more than 451 $cm^2$, but many rackets currently being manufactured have a strung area of less than 590 $cm^2$. The best players often use rackets with an area of about 570 $cm^2$ only.

With such rackets, it is possible to obtain good restitution of energy and good accuracy when the ball is struck at points near the center of the strung surface, where both the main and the cross strings are longest.

Studies of string wear and experiments performed with stroboscopic and electronic equipment have shown that most players generally manage to strike the ball at points close to the X axis of symmetry of the frame.

But specially when trying to return services—which are becoming faster and faster with servers taller and stronger than in the past—even the best players do not have enough time to execute a full swing and to change their body, arm, and hand actions to avoid striking the ball at points distant from axis Y, perpendicular to axis X. With a short swing, the player must rely on the resilience of the strings. But, with impact points spaced from axis Y, the length of cross strings is shorter than in the center of the strung surface and in one direction, there is less than half the main string length between impact points and the frame. Impacts at such points result in poor restitution of energy and accuracy.

When serving, many players, deliberately or instinctively, strike the ball at points as far as possible from the end of the handle, producing poorer restitution of energy with shorter string length, as above explained.

SUMMARY OF THE INVENTION

The present invention provides a racket in which the size of the strung surface lies preferably between 540 $cm^2$ and 590 $cm^2$, with the center of percussion P (the point where contact with a ball produces least shock in the hand of the player, merely rotating the entire racket in the hand without any translation effect and with minimum vibration) lying close to the midpoint M of the portion $X_1$ of axis X, providing excellent restitution of energy and high playing accuracy when the ball is struck close to said points P and M, and maintaining said restitution and said accuracy nearly uniform for a substantial length both along and on either side of the axis of symmetry X, while the results obtained when the ball is struck at points which are relatively close to the tip of the racket or to the yoke are comparable to those obtained with rackets having much larger total strung surfaces.

DESCRIPTION OF THE DRAWINGS

The invention will be better understood from the description which follows, taken together with the accompanying drawings, in which.

DESCRIPTION OF A PREFERRED EMBODIMENT OF THE INVENTION

The strung surface of a racket according to the invention comprises five zones separated from one another by lines running parallel to the axis Y, including a central zone A (see FIGS. 3 and 4) containing at least three cross strings, and also including both the center of percussion P and the point M where the X and Y axes intersect, and on either side of the central zone, two zones B and C, each also including at least three cross strings whose average length is greater than that of the cross strings in the central zone, and two other zones D and E extending to the tip of the racket and to its yoke, respectively, the surfaces of zones D and E being larger than the corresponding surfaces of same-size rackets having a total strung surface which is approximately oval.

The main characteristics of a nonlimiting example of the invention appear from a comparison between a strung surface in accordance with the invention and the strung surfaces of two rackets in widespread use at the present time.

Figures 1, 2, 3:
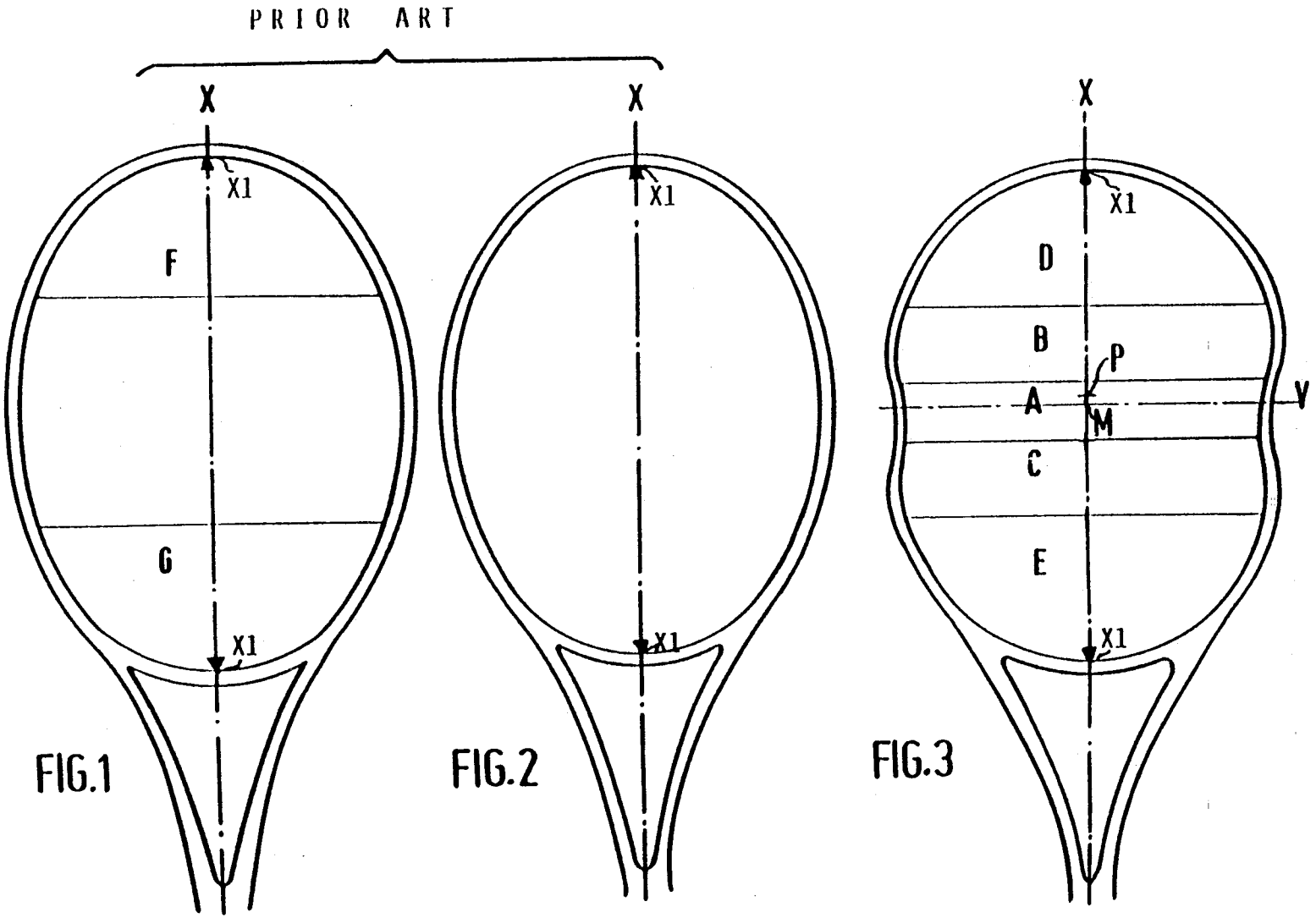
FIG. 1 shows a portion of a racket of the prior art, having a strung surface of 604 $cm^2$, which exceeds the conventional old surface of 451 $cm^2$ by 34%, thereby putting this racket in the category "super mid-size".
FIG. 2 shows a portion of a second racket of the prior art having a string surface of 533 $cm^2$, which exceeds the surface of 451 $cm^2$ by less than 20%, thereby putting the racket in the category "small mid-size".
FIG. 3 shows a strung surface of a racket in accordance with the invention.

In order to facilitate understanding, the stringing is not shown in FIGS. 1 and 2, but the stringing is conventional on the frames shown in the figures.

In FIG. 1, the longest main strings are 32 cm long and the longest cross strings are 24 cm long.

In FIG. 2, the longest main strings are 30.5 cm long and the longest cross strings are 22.2 cm long.

Figure 4:
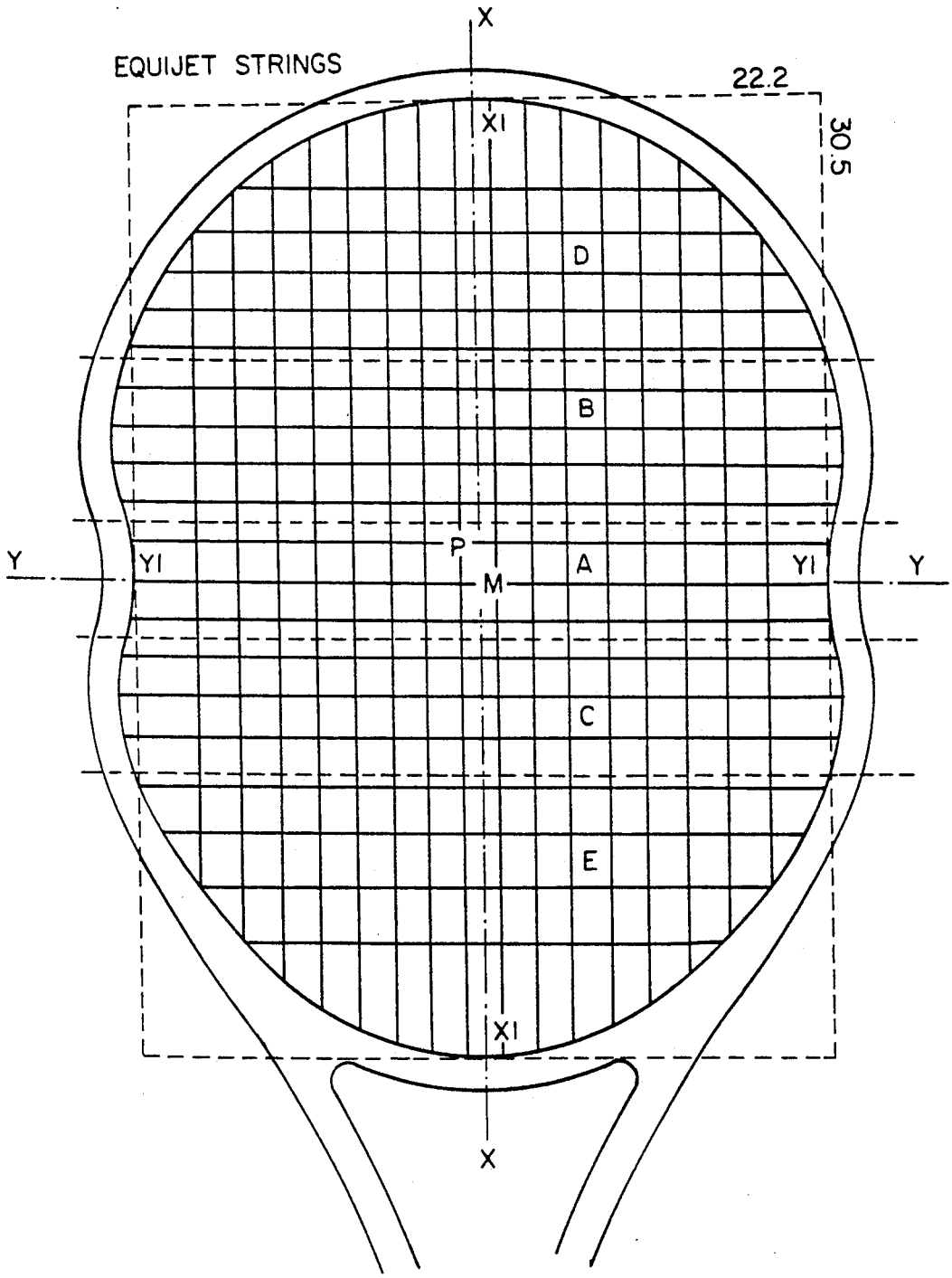
FIG. 4 shows the strung surface of FIG. 3 on a larger scale.

In FIGS. 3 and 4, the longest main strings have the same length as in FIG. 2, while the cross strings close to the axis Y have about the same 22.2 cm length as the longest cross strings in FIG. 2.

The point M represents the intersection of the axes X and Y, and the point P represents the center of percussion of the racket according to the invention.

In FIG. 4, two dotted lines on either side of the points M and P around which impact gives the best results delimit a central zone A including three cross strings. Two other lines delimit two zones B and C including, respectively, four and three cross strings, and disposed on either side of the zone A. These lines also delimit two other zones D and E, which extend respectively to the tip of the racket and to its yoke.

In accordance with the invention, at least three of the cross strings in the zones B and C are slightly longer, respectively, by 5 mm to 10 mm, than the cross strings in the zone A, and considerably longer than the lengths of the cross strings of the strung surface in FIG. 2.

Two straight lines in FIG. 1 delimit two zones F and G whose widths parallel to the axis X are equal to the widths of the zones D and E in FIGS. 3 and 4.

By measuring the surfaces of the zones D and E, and of the zones F and G, one finds that although the total strung surface of a racket in accordance with the invention is less than that in FIG. 1 (572 $cm^2$ v. 604 $cm^2$), the surfaces of the zones D and E (136 $cm^2$ and 135 $cm^2$) are equal to or greater than the surfaces of the zones F and G (135 $cm^2$ and 131 $cm^2$).

Figure 5:
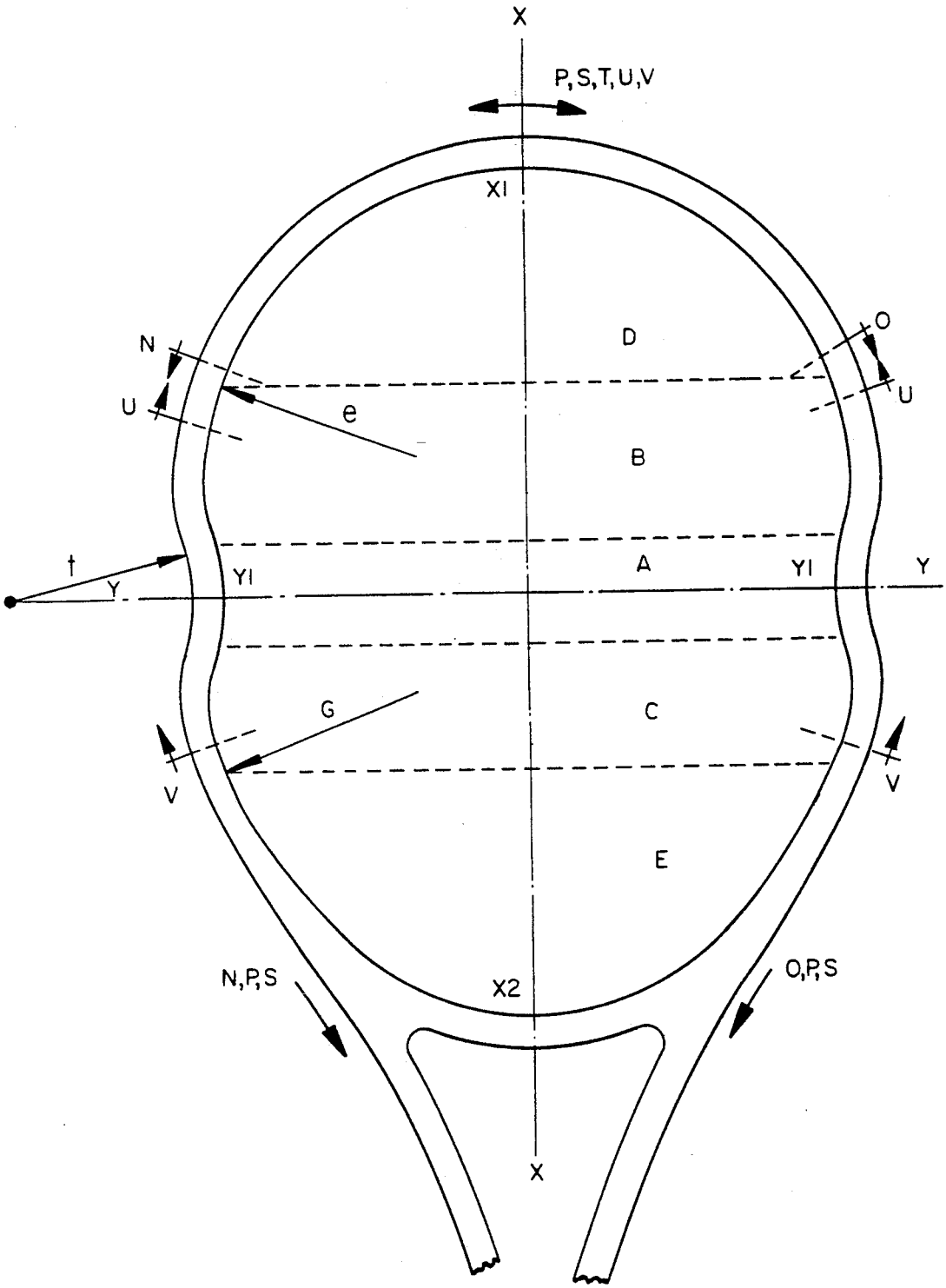
FIG. 5 shows a preferred shape of the frame in accordance with the invention.

FIG. 5 shows a preferred nonoval shape of the frame which achieves the length differences above explained by including a sinuous part on each side of the frame. Each sinuous part is made of an inturned arch between two out-turned arches.

The two inturned arches, one on each side of the frame, limit zone A of the strung surface.

The two pairs of outturned arches limit respectively the zones B and C of the strung surface.

The shapes of the outturned arches are achieved with small radii ($\rho$ and $\sigma$) and are distinct from the shape of the rest of the frame. The inturned arch is made with a very small radius ($\tau$).

Figure 6:
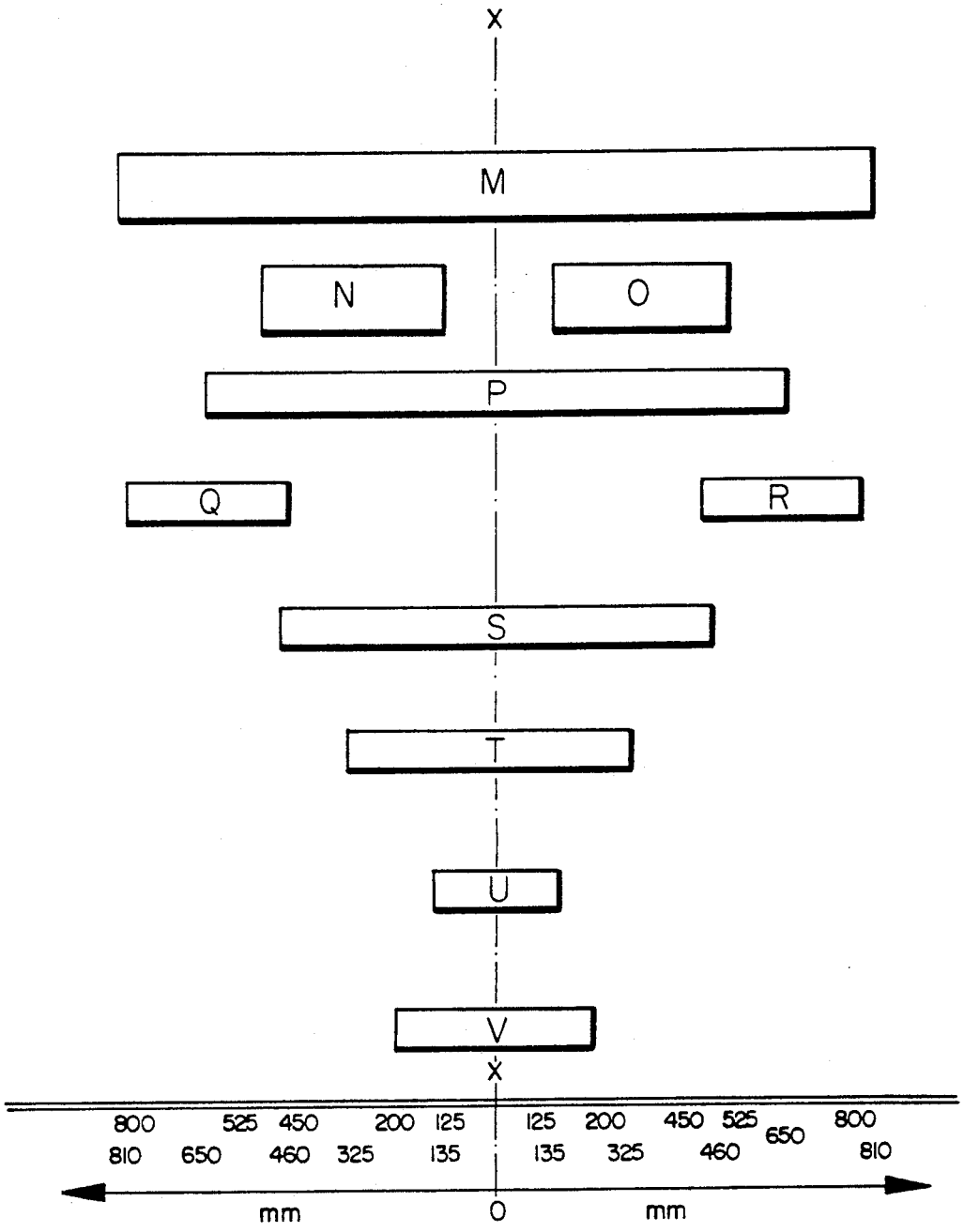
FIG. 6 shows a lay-up of the resin-impregnated fibers bands which constitute the frame of a preferred embodiment of the invention.

FIG. 6 shows the lay-up of bands of resin impregnated fibers which reinforce the frame wherever necessary to achieve a frame which is as rigid as possible consistent with desired size, weight, and other constraints. In a preferred embodiment, the frame of the invention is assembled in accordance with the following process:

a first band M, consisting of a layer of resin-impregnated carbon fibers with a length of 1620 mm and a width of 112 mm is prepared, with the carbon fibers making a 19° angle with the longitudinal axis of the band;

two other bands N and O, both with a length of 400 mm and a width of 112 mm, are cut from a layer of resin-impregnated carbon fibers, with the fibers running parallel to the band axis. Bands N and O are placed upon band M separated by a distance of 250 mm.

Other bands of resin-impregnated fibers, all having a 57 mm width, are then cut and stacked consecutively on the assembly of bands M, N, and O, as follows:

a 1300 mm long band P of carbon fibers making a 19° angle with the band axis;

two 350 mm long bands Q and R with glass fibers parallel to their axis, separated by 900 mm;

a 920 mm long band S with carbon fibers making a 30° angle with the band axis;

a 650 mm long band T with carbon fibers parallel to the band axis;

a 270 mm long band U with carbon fibers parallel to the band axis;

a 400 mm long band V with glass fibers parallel to the band axis.

The stack made with these superimposed bands is then rolled around an inflatable polyamide tube which is kept straight during assembly by a metal rod in its inside. The rod is then taken out and the fabric-covered flexible tubing is placed in the bottom part of a mold having the desired shape of the racket. A yoke completing the frame, similarly made with several bands of resin-impregnated fabric rolled around a cylinder, is then put in place. The top part of the mold is closed and compressed air is injected into the inflatable tube in order to press the outside of the fabric-covered tubing against the inside wall of the mold. The mold is heated to cause the resin to polymerize, after which the assembly is taken out of the mold. Another molding operating adds an appropriately shaped volume of polyurethane around the ends of the tubing to constitute the handle and the racket is finished.

In the above manufacturing process:

the length of the bands N and O, and the distance between them, determine where the sides of the frame, including the sinuous parts, are reinforced;

the band P reinforces most of the racket;

the bands Q and R reinforce the handle;

the bands S, T, U, and V all reinforce the tip of the racket to prevent its breakage when it strikes the ground accidentally.

The approximate location of bands N, O, S, T, U, and V is indicated in the racket shown in FIG. 5.

With this reinforcement of the tip of the racket, with a rigid yoke and with the reinforcement provided on the sides of the racket by bands N and O, and perhaps also by the small radii characterizing the arches of the sinuous part, especially the central inturned arches, the frame is very rigid. Any tendency of the racket frame to be resilient because of the presence therein of the arches in the sides of the frame is counteracted by the reinforcing bands, particularly N and O, thus insuring that the racket is substantially uniformly rigid throughout.

Because of the reinforcement of the racket, the shape of even a very light frame remains practically undistorted on contact with a ball and the distance between the central arches is not significantly reduced, even when a powerful stroke is used.

TESTS IN PLAY

Prototype rackets in accordance with the invention of the type made by La Chemise LACOSTE, the assignee of the present invention, under its registered trademark Equijet, were initially given to players who normally use conventionally shaped rackets with approximately oval strung surfaces as shown in FIG. 1, or having strung surfaces of even greater than 604 $cm^2$.

After immediately becoming aware of the great ease with which Equijet rackets, in accordance with the invention, can be moved by virtue of their reduced strung area of 572 $cm^2$, these players found very quickly that the Equijet rackets provided the same sensation of good general resilience that they liked about their usual rackets having large strung surfaces, and, in particular, they like the good results obtained from off-center strikes and the overall improved playing accuracy.

Very good players who normally use rackets of the type shown in FIG. 2 having a strung area of 533 $cm^2$ said that they obtained the same playing speed with the Equijet, and some even felt that they could serve faster balls, and all were agreeably surprised by the playing accuracy obtained, particularly for returning service, and also by the nearly total lack of string vibration, giving rise to a pleasant, comfortable feel.

In order to specify the advantages obtained by the invention more accurately and to determine the means that make it possible to obtain both greater accuracy and greater playing comfort, the inventors had electronic measurements performed in play and had laboratory testing undertaken in order to compare an Equijet racket (strung area 572 $cm^2$) with two new types of racket, one called Top 340 having a strung area of 599 $cm^2$ (slightly less than shown in FIG. 1), and the other called Top 240 having a strung area of 563 $cm^2$, which is closer to the strung area of the Equijet than is the racket shown in FIG. 2 (533 $cm^2$). The "Top" rackets are produced by the assignee of the present invention.

ELECTRONIC MEASUREMENTS IN PLAY

These measurements were performed by a testing establishment set up to monitor "Innovations and Research in Sport" (INRES).

Very good players were recruited to perform fast serves, i.e., to strike balls at rest.

With each of the three types of racket (Equijet, Top 340, and Top 240), 24 balls were struck as accurately as possible by each of three points on each racket: a point PO in the center of the stringing, a point PE between PO and the yoke, and a point PT by PO and the tip end of the racket frame.

The speed of the racket immediately before impact and the speed of the ball after impact were measured using an Orthotron stroboscope at a frequency of 100 Hz.

Results are summarized in Table 1 for a racket travelling at 120 km/h.

For the stringing of the Equijet racket:

restitution expressed as ball velocity over racket velocity (VB/VR) is 1.8 at the point PO, 1.77 at the point PE, and 1.81 at the point PT. Compared with the restitution of 1.8 at the point PO, there is, therefore, only a small difference of 0.04 in total for the restitution at each of the three points, with a mean difference of 0.02 only.

For the stringing of the Top 340 racket, the table provides figures showing that the total difference in restitution between these three points is 0.29 for a mean difference of 0.145.

For the stringing of the Top 340 racket, the table provides figures showing that the total difference in restitution between these three points is 0.29 for a mean difference of 0.145.

For the stringing of the Top 240 racket, the table provides figures showing that the total difference in restitution is 0.25 and the mean difference is 0.125.

These differences in restitution of 0.02 compared with 0.145 and 0.125 provide a good explanation for the "feel" in play, and in particular for the great accuracy obtained using Equijet rackets of the invention.

TABLE 1

| Type of Racket | Equijet of the Invention | Top 340 | Top 240 |
|---|---|---|---|
| Area of stringing | 575 $cm^2$ | 599 $cm^2$ | 563 $cm^2$ |
| Restitution-at point PO | 1.80 | 1.91 | 1.88 |
| Ball velocity-at point PE | 1.77 | 1.80 | 1.70 |
| Racket velocity-at point PT | 1.81 | 1.73 | 1.77 |
| Total difference between PO and the other 2 points | 0.04 | 0.29 | 0.25 |
| Mean difference | 0.02 | 0.145 | 0.125 |

Measurements performed at other racket velocities: 110 km/h and 130 km/h gave comparable results.

Also, it might be thought from the above figures, e.g., of restitution at PO, that a faster service ball is obtained with the Top 340 racket and a slower ball with the Top 240 racket, however, the velocity of the racket must also be taken into consideration since the velocity of the ball is proportional thereto and both velocities are influenced by the aerodynamic drag which naturally depends on the strung area.

LABORATORY TESTING

Tests on the same three rackets were performed by the firm Sopemea whose laboratories are used for testing much of the equipment and instrumentation used in aircraft and rockets manufactured in France.

In order to specify more accurately the advantages obtained by a stringing in accordance with the invention, comparisons were made between the string vibration of each of the three rackets after the frames thereof had been fixed rigidly in order to eliminate frame vibration.

The resonant frequencies of the stringing were determined by an excitation hammer (fitted with a sensor) for striking the stringing and an accelerometer mounted on the stringing.

Working on the first resonant frequency, a traction corresponding to a mass of 2 kg was applied at numerous points with the traction then being released without shock by burning the cord which had been transmitting it.

The acceleration following the release was recorded by means of an Endevco 2222C accelerometer having a weight of 0.5 grams fixed on the stringing, and the resulting signal was processed by an SD380 analyzer to evaluate the various energies corresponding to the different resonant frequencies of the stringing.

The energy maximum Er corresponding to the first resonant frequency of the stringing was thus determined, as was the total energy Et corresponding to the sum of all of the energies observed at each of the frequencies.

At a given point i on the stringing, point restitution is given by:

$$ri=(Eri/Et).$$

Then, in order to compare the restitution of each stringing as a function of the point struck by the ball, the restitution at each point i was normalized as a percentage as follows:

Ri %=100 (ri/r maximum) where r maximum=Max (r1,r2, . . . , rn).

Figure 7:
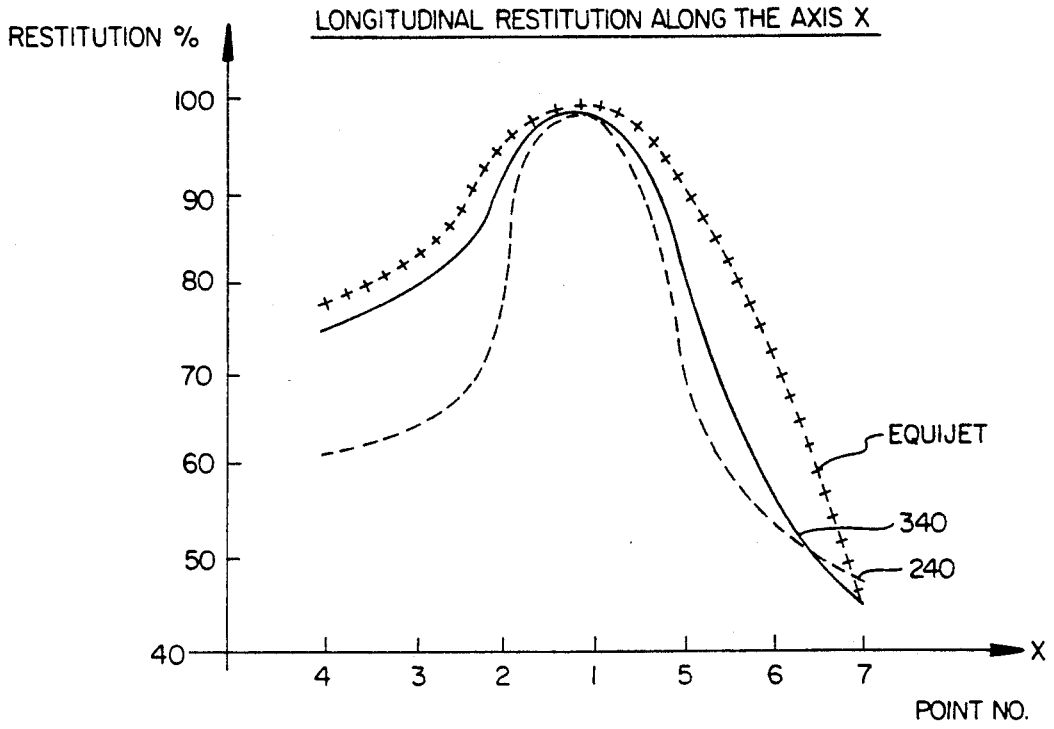
FIG. 7 is a graph showing the longitudinal restitution of energy along the axis X of a racket of the invention, and of two other conventional rackets of the prior art.
Figure 12:
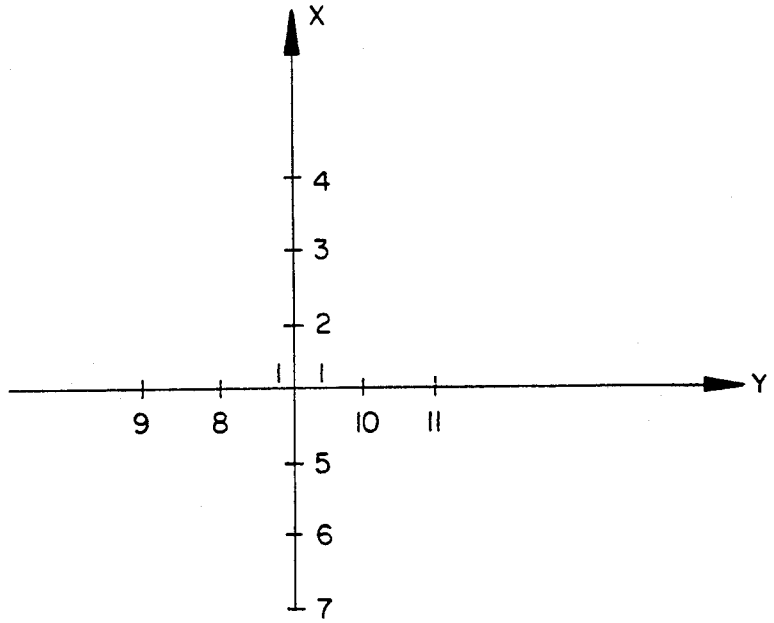
FIG. 12 shows the measurement points used in laboratory testing.

In FIG. 7, the numbers 4, 3, 2, 1, 5, 6, 7 indicate the positions of points along the axis X of the three strings at intervals of 2.4 cm. The number 1 indicates the position of the central cross string. The disposition of the measurement points in both the X and the Y directions is given in FIG. 12.

On the graph of FIG. 7, the three curves show, for each of the three rackets under investigation, how the restitution varies for the stringing as a function of the positions of the points at which the various pressures were exerted.

It can thus be seen that with the Equijet racket of the invention, restitution between points 3 and 4, and between points 5 and 6, is still 80% of the restitution at point 1 in the geometrical center of the stringing. Given that the points are at 2.4 cm intervals, the restitution is thus equal to or greater than 80% over a stringing length of 9.6 cm.

In contrast, on moving away from the center, restitution falls off somewhat faster with the stringing of Top 340 and much faster with the stringing of Top 240, in which case the 80% figure is maintained over only about half the length.

Figure 8:
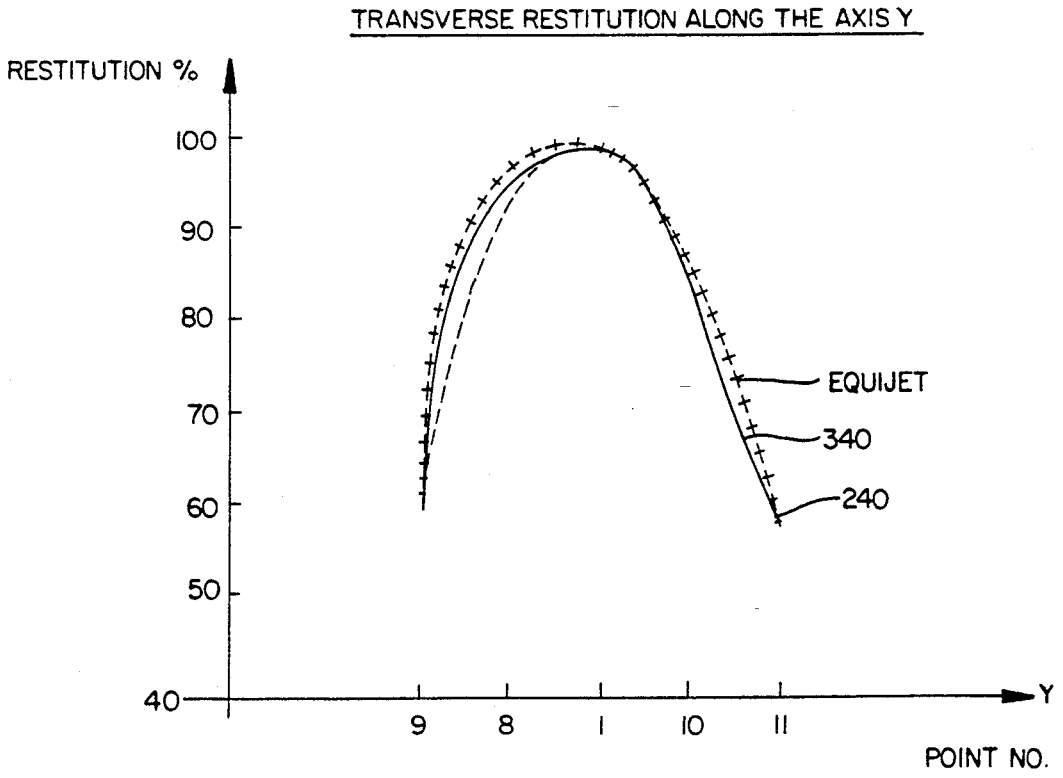
FIG. 8 is a similar graph showing the transverse restitution along the axis Y.

FIG. 8 shows what happens for the three rackets for points placed along the axis Y on either side of the geometrical center. In this case, the change in restitution is equivalent for all three rackets. The points 9, 8, 1, 10, and 11 are points on the axis Y at 2.4 cm intervals, with the point 1 occupying the position of the central main string.

However, as mentioned above, whereas the racket can be raised or lowered by a simple wrist movement in order to strike the ball as close as possible to the axis X, it is much more difficult, particularly when receiving a fast service, to be sure of striking the ball at the geometrical center in the middle of the axis Y, or at any rate close to the axis Y. That is why it is extremely useful to be able to maintain at least 80% of restitution over more than 9 cm along the axis X.

The vibration curves that were used for determining restitution at various points of the stringing were also used for investigating vibration damping.

Figure 9:
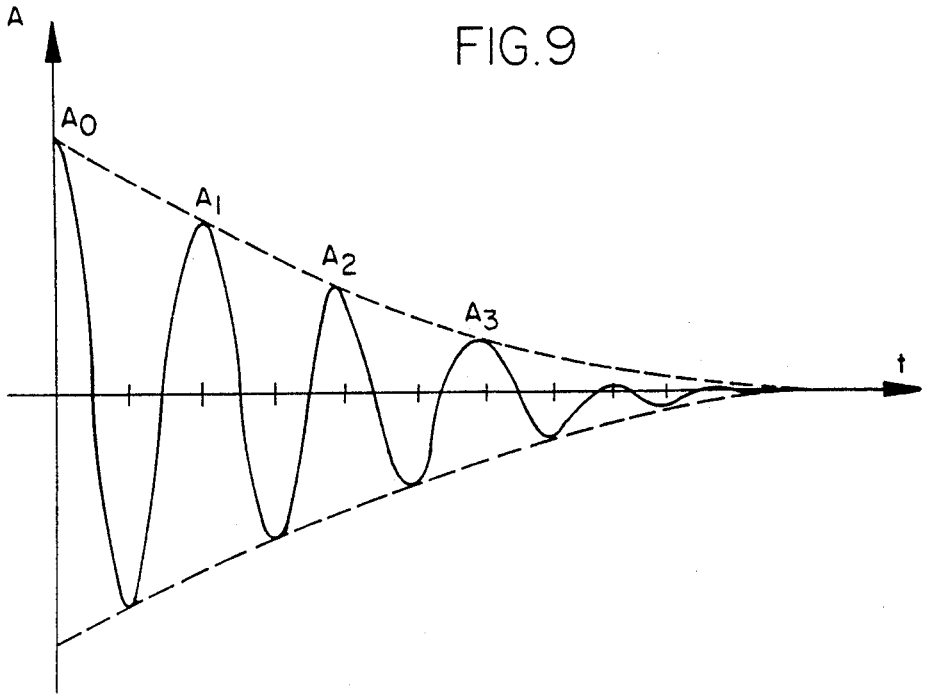
FIG. 9 is a graph showing the damping of vibration as a function of time following an impact.

In the example vibration of FIG. 9, it can be seen that the amplitude of the signal decreases exponentially.

The damping criterion is therefore defined by the following equation:

$\alpha=\lambda/2\pi f$ where f is the frequency of vibration $\lambda$ is the value measured from the different values of maximum amplitude.

Figure 10:
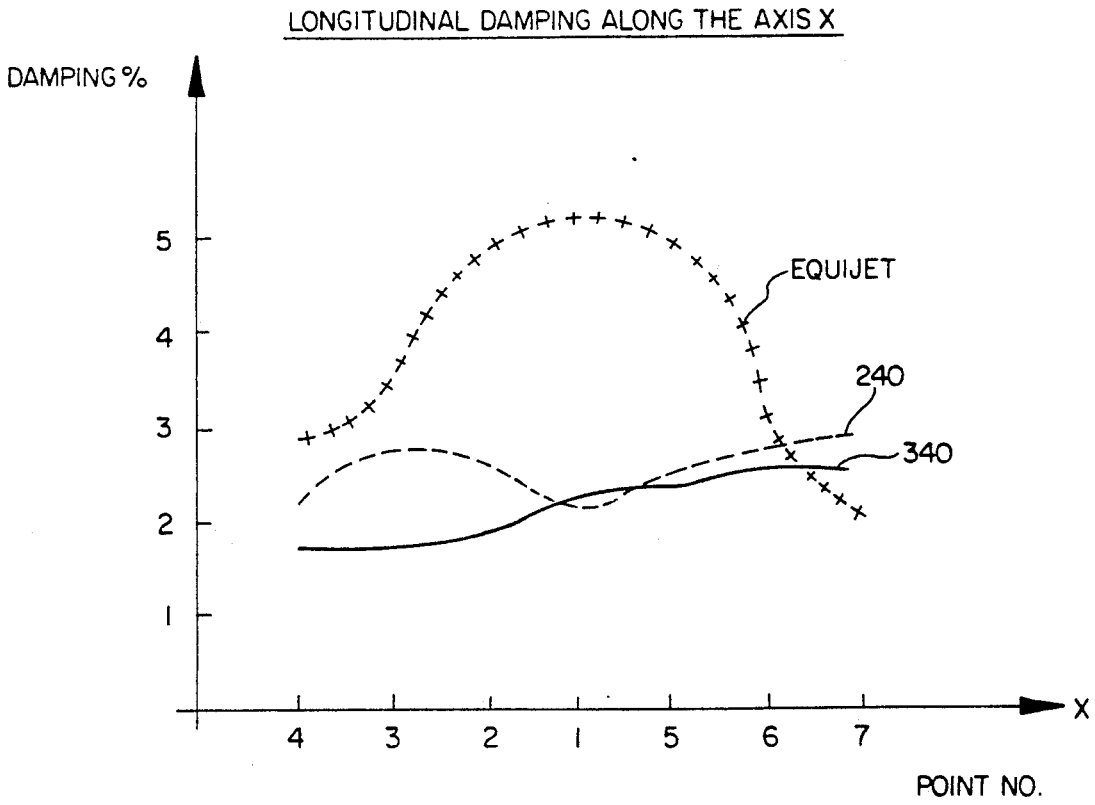
FIG. 10 is a graph showing longitudinal damping as a function of the position of the point of impact along the axis X.
Figure 11:
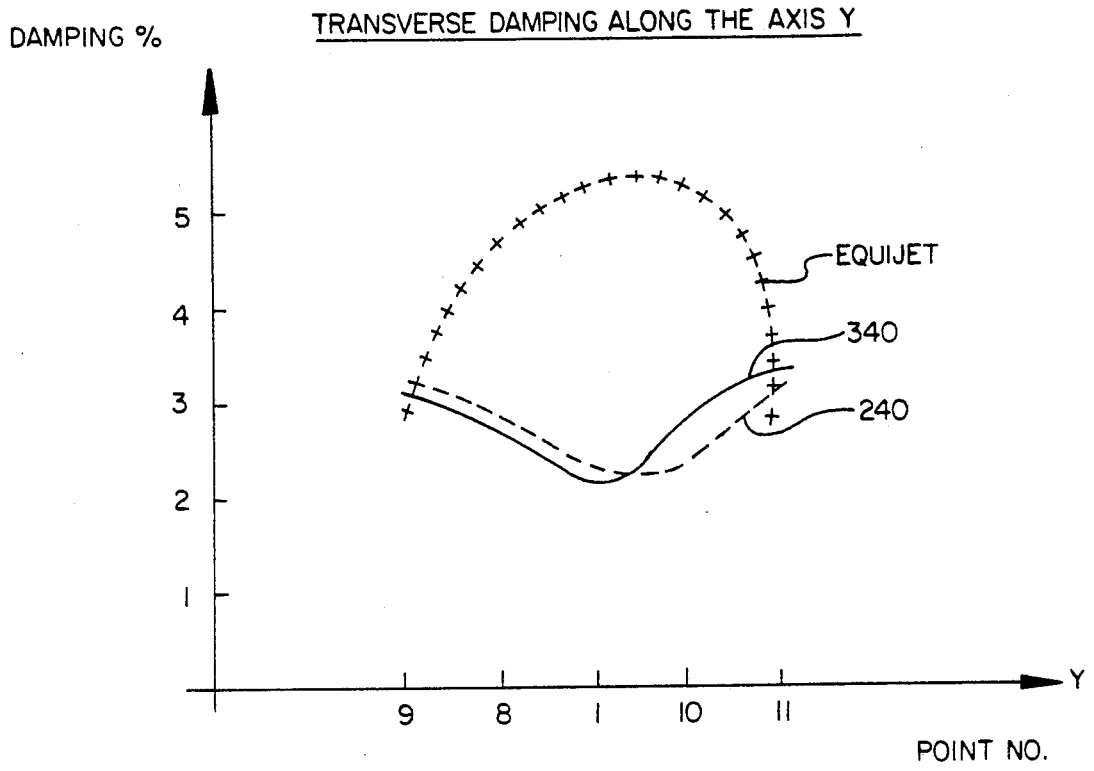
FIG. 11 is a graph of transverse damping along the axis Y.

FIG. 10 and 11 are graphs showing this damping criterion as a function of the position of the point of impact on the stringing.

Naturally, the greater the damping, the quicker the vibration disappears.

Under these conditions, it can be seen in FIGS. 10 and 11 that when the ball is struck in a zone extending over a distance of more than 4 cm in the vicinity of the geometrical center of the racket, both along the axis Y and along the axis X, $\alpha$ lies in the range 4% to 5% for the racket of the invention, whereas for the other two rackets, $\alpha$ never exceeds 3% along the axis X or 3.5% along the axis Y, and is hardly greater than 2% in the geometrical center of the stringing which shows that vibration disappears much more quickly with a racket of the invention than with either of the other two rackets and that striking a ball is certainly more agreeable and more effective, particularly in the geometrical center of the stringing.

What is claimed is:

1. A tennis racket comprising a rigid closed frame delimiting a strung surface and a handle connected to the frame, the strung surface comprising main strings running parallel to the axis of symmetry X of the frame and cross strings parallel to an axis Y perpendicular to axis X and crossing it at a point M near the middle of a section $X_1$ of the axis X within said frame, the racket being characterized in that the strung surface comprises five zones:

a central zone A, including both the point M and the center of percussion P together with at least three cross strings;

two zones B and C, one on either side of zone A, each including at least three cross strings having an average length exceeding the average length of the cross strings in zone A;

and two zones D and E, respectively, on the sides of zones B and C, said frame containing local reinforcement in the area of attachment of the cross strings in zones A, B, and C sufficient to insure that the frame in zones A, B, and C is substantially as rigid as any other part of the frame.

2. A tennis racket according to claim 1 in which the average length of at least three cross strings in each of zones B and C exceeds the average length of the strings in zone A by 4 to 12 mm.

3. A tennis racket according to claim 1 in which the differences of length between the strings in zones A, B, and C are obtained by attaching said strings to sinuous parts provided on each side of the frame, said sinuous parts each comprising one inturned arch between two outturned arches, the inturned arches delimiting the zone A and the outturned arches delimiting the zones B and C.

4. A tennis racket according to claim 3 made with bands of resin-impregnated fibers laid upon each other before being wound around a core, in which reinforcing bands are provided in the sides of the frame in the region of the sinuous parts, for increasing the rigidity of the frame in these parts.

5. A tennis racket according to claim 1 in which for all points i of the stringing placed along the axis X, and at a distance of no more than 4.8 cm from the axis Y, the energy of restitution is not less than 80% of the energy of restitution at the point M.

6. A tennis racket according to claim 1 in which, in the vicinity of point M, the damping criterion applicable to vibrations created by striking the ball, and as defined by the equation $\alpha=\lambda/2\pi f$, is not less than 4.

* * * * *